US008479635B2

(12) United States Patent
Overstreet et al.

(10) Patent No.: US 8,479,635 B2
(45) Date of Patent: Jul. 9, 2013

(54) DROP BOLT HOLD OPEN ACTUATOR FOR USE WITH AR-15/M16 TYPE FIREARMS IN CONJUNCTION WITH RIMFIRE AMMUNITION

(75) Inventors: John L. Overstreet, Fayette, MO (US); Jordan Bowles, Columbia, MO (US); Tyson Bradshaw, Kirksville, MO (US); Craig Pudil, Boonville, MO (US)

(73) Assignee: 22 Evolution LLC, Columbia, MO (US)

( * ) Notice: Subject to any disclaimer, the term of this patent is extended or adjusted under 35 U.S.C. 154(b) by 344 days.

(21) Appl. No.: 12/987,653

(22) Filed: Jan. 10, 2011

(65) Prior Publication Data

US 2011/0247483 A1 Oct. 13, 2011

Related U.S. Application Data

(60) Provisional application No. 61/321,951, filed on Apr. 8, 2010.

(51) Int. Cl.
*F41A 3/48* (2006.01)

(52) U.S. Cl.
USPC ..... 89/181; 89/187.01; 42/70.02

(58) Field of Classification Search
USPC ..... 89/1.4, 180, 187.01, 187.02, 189, 89/190, 191.01, 196, 199, 138, 137, 33.01, 89/33.1, 1.42, 198, 181; 42/49.01, 49.02, 42/50, 702.02, 14–22, 70.02
See application file for complete search history.

(56) References Cited

U.S. PATENT DOCUMENTS

| | | | | |
|---|---|---|---|---|
| 2,538,799 | A | | 1/1951 | Phillips et al. |
| 3,540,142 | A | | 11/1970 | Vartanian et al. |
| 3,570,366 | A | | 3/1971 | Nickel |
| 3,688,640 | A | | 9/1972 | Seecamp |
| 3,776,095 | A | * | 12/1973 | Atchisson ..... 89/128 |
| 3,846,928 | A | | 11/1974 | Ruger et al. |
| 4,057,003 | A | | 11/1977 | Atchisson |
| 4,058,922 | A | * | 11/1977 | Elbe et al. ..... 42/16 |
| 4,069,608 | A | * | 1/1978 | Jurek ..... 42/49.02 |
| 4,098,016 | A | * | 7/1978 | Foote ..... 42/16 |
| 4,128,042 | A | * | 12/1978 | Atchisson ..... 89/138 |

(Continued)

FOREIGN PATENT DOCUMENTS

WO 0029802 A2 5/2000

*Primary Examiner* — Jonathan C Weber

(74) *Attorney, Agent, or Firm* — Gifford, Krass, Sprinkle, Anderson & Citkowski, P.C.; Douglas J. McEvoy

(57) ABSTRACT

A bolt catch assembly configured for operating with rimfire ammunition for use with a firearm including a receiver with an exposed receiving chamber. The assembly includes a bolt catch actuator housing supported in seating fashion relative to the receiving chamber and communicating with an attachable magazine. A catch actuator is supported in elevatable fashion relative to an end of the actuator housing. A bolt catch component and integrally formed actuator catch engaging portion is slaved to the catch actuator in order to be displaced in response to elevating motion exerted upon the catch actuator, such as by a follower component biasingly disposed within the magazine. The follower, in its uppermost displaced position within the attached magazine, engages a tab associated with the catch actuator which extends over a communicating interior of the bolt catch actuator housing in communicating alignment with the exposed receiving chamber. An end configured location of the bolt catch housing includes a step and ledge profile for supporting an underside of the catch actuator in each of a seated rest position as well as a follower induced and upwardly displaced position.

10 Claims, 5 Drawing Sheets

U.S. PATENT DOCUMENTS

| | | | | |
|---|---|---|---|---|
| 4,142,314 | A * | 3/1979 | Foote | 42/16 |
| 4,433,610 | A * | 2/1984 | Tatro | 89/148 |
| 4,455,919 | A | 6/1984 | Osborne et al. | |
| 4,893,547 | A | 1/1990 | Atchisson | |
| 5,519,954 | A * | 5/1996 | Garrett | 42/6 |
| 5,608,981 | A | 3/1997 | Canaday | |
| 5,638,626 | A * | 6/1997 | Westrom | 42/50 |
| 6,070,352 | A | 6/2000 | Daigle | |
| 6,510,778 | B1 | 1/2003 | Irwin | |
| 6,606,811 | B1 * | 8/2003 | Olson | 42/50 |
| 6,608,811 | B1 | 8/2003 | Holden et al. | |
| 6,722,253 | B2 * | 4/2004 | Johnson | 89/1.42 |
| 6,763,755 | B2 * | 7/2004 | Johnson | 89/1.42 |
| 6,851,346 | B1 * | 2/2005 | Herring | 89/1.4 |
| 6,871,437 | B1 | 3/2005 | Bartozzi et al. | |
| 6,901,837 | B2 * | 6/2005 | Johnson | 89/1.4 |
| 7,219,462 | B2 * | 5/2007 | Finn | 42/49.01 |
| 7,261,029 | B1 | 8/2007 | Davis | |
| 7,364,057 | B2 | 4/2008 | Carroll | |
| 7,497,044 | B2 | 3/2009 | Cammenga et al. | |
| 7,562,614 | B2 | 7/2009 | Polston | |
| 7,568,422 | B1 | 8/2009 | Barrett | |
| 7,661,219 | B1 * | 2/2010 | Knight et al. | 42/70.02 |
| 7,823,312 | B2 | 11/2010 | Faifer | |
| 7,937,872 | B1 | 5/2011 | Fluhr | |
| 8,015,742 | B2 * | 9/2011 | Zedrosser | 42/70.04 |
| D652,468 | S * | 1/2012 | Burt et al. | D22/108 |
| 8,161,861 | B2 * | 4/2012 | Haley et al. | 89/1.4 |
| 8,261,652 | B2 * | 9/2012 | Findlay | 89/181 |
| 8,327,749 | B2 * | 12/2012 | Underwood | 89/138 |
| 2003/0208940 | A1 * | 11/2003 | Johnson | 42/18 |
| 2004/0255766 | A1 * | 12/2004 | Johnson | 89/1.42 |
| 2005/0000138 | A1 | 1/2005 | Kiss | |
| 2005/0011345 | A1 * | 1/2005 | Herring | 89/1.4 |
| 2005/0183310 | A1 | 8/2005 | Finn | |
| 2008/0092733 | A1 | 4/2008 | Leitner-Wise et al. | |
| 2009/0288326 | A1 | 11/2009 | Twardy | |
| 2010/0162604 | A1 * | 7/2010 | Dubois | 42/18 |
| 2010/0251591 | A1 * | 10/2010 | Burt et al. | 42/70.01 |
| 2010/0275485 | A1 * | 11/2010 | Findlay | 42/16 |
| 2011/0056107 | A1 * | 3/2011 | Underwood | 42/18 |
| 2011/0078937 | A1 | 4/2011 | Rich | |
| 2011/0079132 | A1 | 4/2011 | Rich | |
| 2011/0107902 | A1 | 5/2011 | Quetschke et al. | |
| 2012/0167424 | A1 * | 7/2012 | Gomez | 42/14 |

* cited by examiner

FIG. 3
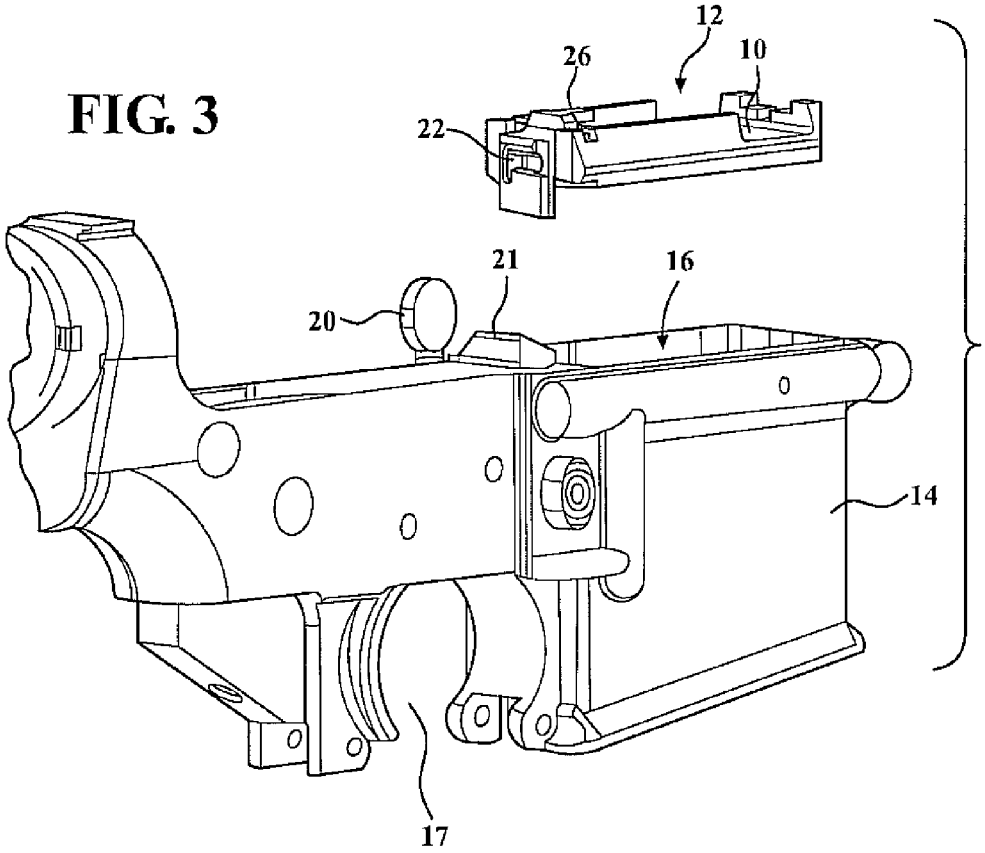
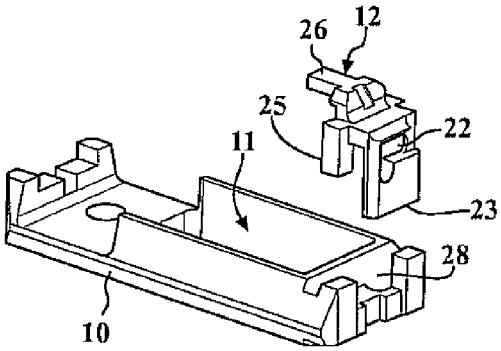
FIG. 4
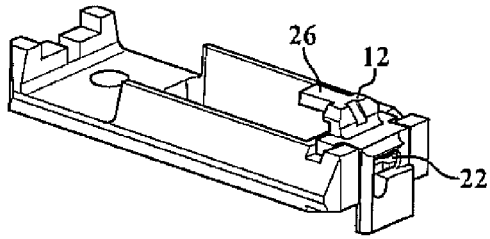
FIG. 5

DROP BOLT HOLD OPEN ACTUATOR FOR USE WITH AR-15/M16 TYPE FIREARMS IN CONJUNCTION WITH RIMFIRE AMMUNITION

CROSS-REFERENCE TO RELATED APPLICATIONS

This Application claims the benefit of U.S. Provisional Application 61/321,951 filed on Apr. 8, 2010.

FIELD OF THE INVENTION

The present invention relates generally to a bolt catch kit for establishing a last shot bolt hold open position. More specifically, the present invention teaches a bolt catch accessory fitting between upper and lower receiver assemblies associated with such as right or left handed AR-15 firearms, and which provides full function bolt hold open/release capabilities. The catch assembly is capable of functioning with rim fire conversion ammunition, and in particular any style of rim fire action firearm including but not limited to conversion and dedicated 0.22 kits.

BACKGROUND OF THE INVENTION

The prior art is documented with examples of bolt catch mechanism, such as incorporated into AR-15/M-16 type firearms. One purpose of such bolt catch mechanisms is the ability to hold open a bolt or slide of a firearm firing mechanism in order to inspect the chamber after all rounds supplied by a magazine have been discharged. One known example of an ammunition magazine with internally supported and upwardly spring biased follower body is disclosed in Westrom, U.S. Pat. No. 5,638,626 and which discloses a bolt catch actuator coupled to the follower. The actuator is biasingly seated within the follower and further exhibits an actuation finger which, upon aligning the follower with a notch indicative of a last shot being fired, projects the finger through the notch in order to contact the bolt catch and restrain the reciprocating bolt in the open position.

SUMMARY OF THE INVENTION

The present invention discloses a bolt catch assembly for use with a firearm including a receiver with an exposed receiving chamber. The assembly includes a bolt catch actuator housing supported in seating fashion relative to the receiving chamber and communicating with an attachable magazine. A catch actuator is supported in elevatable fashion relative to an end of the actuator housing.

A bolt catch component and integrally formed actuator catch engaging portion is slaved to the catch actuator in order to be displaced in response to elevating motion exerted upon the catch actuator, such as by a follower component biasingly disposed within the magazine. The follower, in its uppermost displaced position within the attached magazine, engages a tab associated with the catch actuator which extends over a communicating interior of the bolt catch actuator housing in communicating alignment with the exposed receiving chamber. An end configured location of the bolt catch housing includes a step and ledge profile for supporting an underside of the catch actuator in each of a seated rest position as well as a follower induced and upwardly displaced position.

BRIEF DESCRIPTION OF THE DRAWINGS

Reference will now be made to the attached drawings, when read in combination with the following detailed description, wherein like reference numerals refer to like parts throughout the several views, and in which:

FIG. 3 is a rotated and partially exploded perspective illustrating the bolt catch actuator and actuator housing;

FIG. 4 is an enlarged and exploded perspective of the bolt catch actuator and actuator housing depicted in FIG. 3;

FIG. 5 is an assembled view of the bolt actuator assembly;

DETAILED DESCRIPTION OF THE PREFERRED EMBODIMENTS

Referring now to the several illustrations, the present invention teaches a bolt catch accessory installed between upper and lower receiver assemblies associated with any suitable firearm but in one applicable variant to any of a related family of M-16 or AR-15 firearms. The invention in particular discloses a bolt catch actuator housing supported in any desired fashion not limited to a drop in style housing within an upper exposed rim of a lower receiver housing chamber and which includes an end supported and elevatable bolt catch actuator for in turn engaging a conventional bolt catch component associated with a reciprocating bolt of the firearm.

Figure 6A:
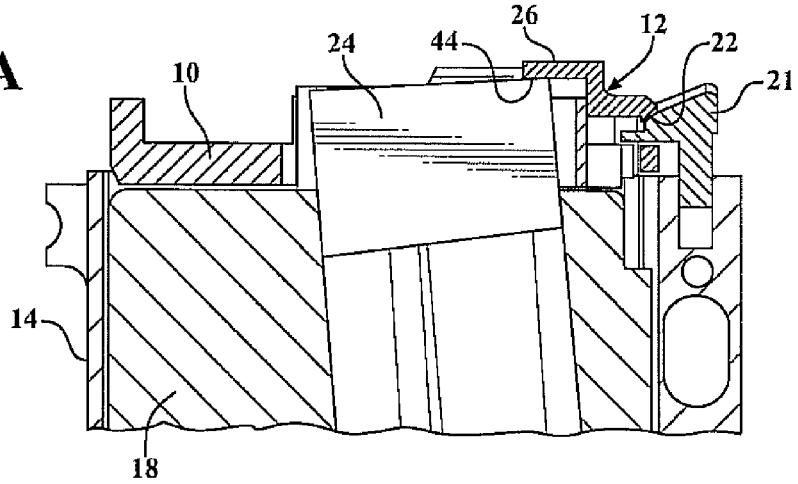
FIG. 6A is a side cutaway sectional view depicting the bolt catch assembly installed upon the lower receiver, with the magazine inserted and showing the bolt catch in an engaged position by the bolt catch actuator.
Figure 6B:
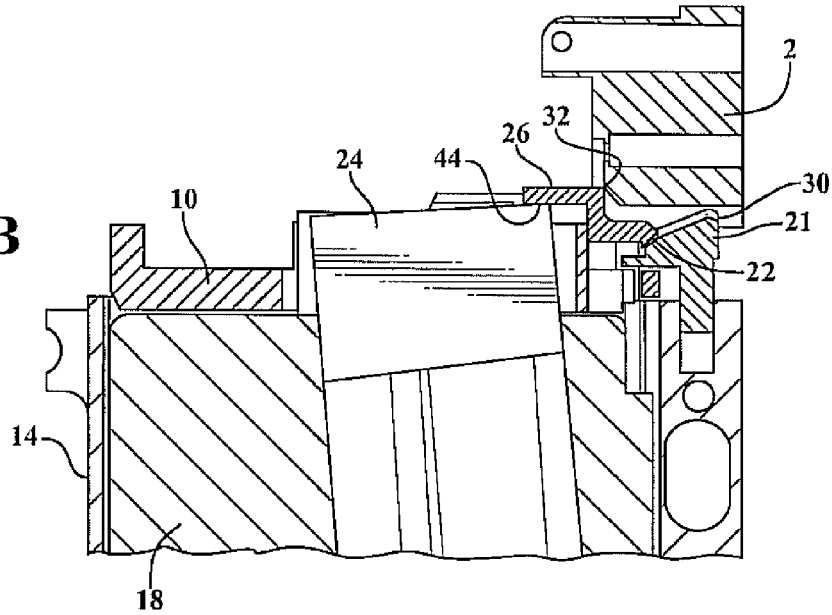
FIG. 6B is a succeeding illustration depicting the upwardly biasing bolt catch actuator likewise upwardly translating the bolt catch in an obstructing position to a reciprocating bolt.

The bolt catch assembly (in use with reciprocating bolt 2 representatively depicted in FIG. 6B) is defined by an actuator housing 10 and a supported and elevate-able bolt catch actuator 12 and is particularly configured for operating with rim fire ammunition (as opposed to center fire ammunition in which the firing pin strikes a primer cap at the center of a base of the cartridge). As is further known, rim fire ammunition includes a widened base rim which is essentially a widened percussion cap containing the desired priming compound, while the associated cartridge case itself contains the propellant powder and projectile (bullet).

Figure 1:
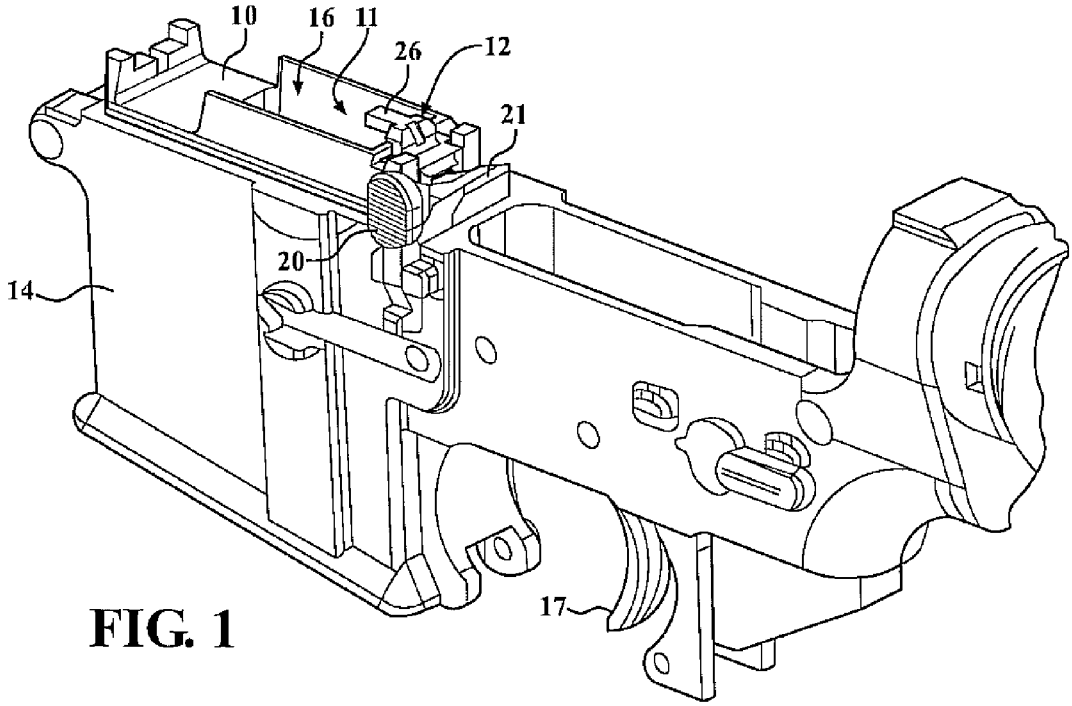
FIG. 1 is a sectional perspective of a lower receiver with exposed receiving chamber for communicating with an attachable magazine and within which is drop installed the bolt catch actuator.

Referring to FIG. 1, a sectional perspective is shown of a lower receiver 14 with exposed receiving chamber 16 in proximate location to a trigger assembly 17. The bolt catch actuator housing 10 is not limited to any particular configuration however, and in the variant shown, exhibits a generally four sided rectangular configuration with an open interior, defined by inner perimeter wall 11.

Figure 2:
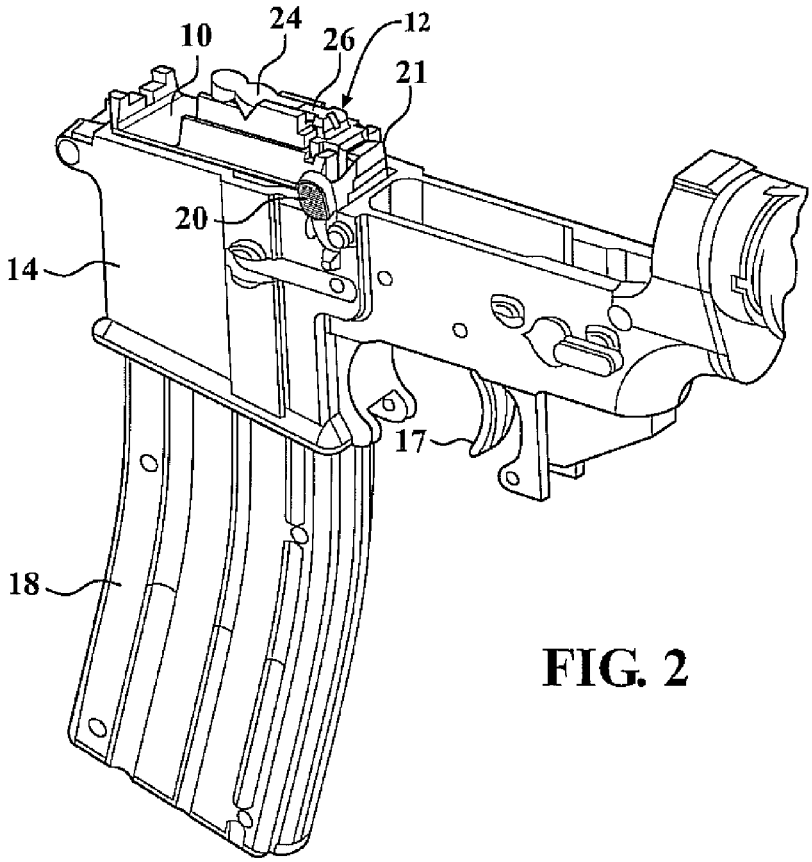
FIG. 2 is a related sectional perspective and further illustrating the magazine engaged to the open underside of the lower receiver chamber.

The housing 10 is dimensioned for drop in seating relative to an upper communicating surface of the receiver surrounding the receiving chamber 16 and such that the perimeter 11 defining open interior communicates with both the open receiving chamber 16 and with underside attachable magazine 18 (FIG. 2). As further described below, the catch actuator 12 is vertically displaceably supported at an end of the housing 10 in communication with its perimeter defined interior and in selectively elevate-able fashion.

Figure 6C:
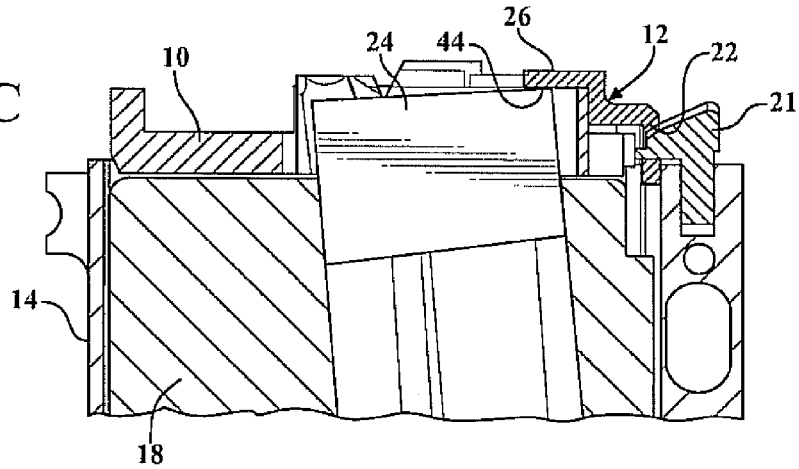
FIG. 6C illustrates a further position in which the bolt catch actuator is depressed by the bolt catch, such as to release the bolt.

The lower receiver further includes a bolt catch, this being typically built into the receiver and illustrated by a user engageable (thumb actuated) portion 20 which in turn vertically actuates in one manual operation an integrally formed catch 21 which is further shown in communication with a forward end of the receiver chamber. As best depicted in each of FIGS. 6A-6C, the bolt catch 21 exhibits a narrowed taper seated within an open configured window 22 of the catch actuator 12 (see also FIG. 4) in order to be displaced in slaved fashion responsive to elevating motion exerted upon the catch actuator 12, such as by a follower component (see at 24 in FIG. 2) biasingly disposed within the magazine 18 by a spring underneath a last of a plurality of cartridges (not shown) which are progressively discharged by virtue of the reciprocating bolt action of the firearm operation.

The follower 24 is an existing internal component of the magazine 18 and, in its uppermost displaced position within the attached magazine as depicted in FIG. 2, engages a tab portion 26 of the catch actuator 12 which extends over the communicating interior of the bolt catch actuator housing 11 and in communicating alignment with the exposed receiving chamber 16 (see also FIG. 6B). As further best shown in FIG. 4, a supporting end of the bolt catch housing 10 is exhibited by an end configured location 28 including a step and ledge profile (see spaced apart legs 23 and 25 associated with the catch actuator 12 which straddle the end location 28) and which enables the underside of the catch actuator 12 to be supported in each of a seated rest position (FIG. 6C) as well as follower induced and upwardly displaced position (FIG. 6B).

Further variants of the invention contemplate use of the bolt catch actuator housing 10, without the associated bolt catch actuator 12. This can occur in situations where other rim fire type cartridges are employed and where it is desired to employ the actuator housing 10 alone in order to provide for a tighter fit with the upper engaging end of the magazine 18.

As previously described, FIG. 6A is a side cutaway sectional view depicting the bolt catch housing 10 installed upon the lower receiver 14 and with the magazine 18 inserted and showing the bolt catch 21 engaging the bolt catch actuator 12. As further depicted in FIG. 6B, the upwardly biasing bolt catch actuator 12 (again resulting from a spring induced elevation of the follower component 24 supported within the magazine engaging the overhead extending tab portion 26) likewise upwardly translates the bolt catch 21 (slaved to the actuator 12 again by seating window 22) in an obstructing position relative the reciprocating bolt 2 as further depicted by abutting location 30 (again FIG. 6B) and which is additional to a secondary abutting location 32 established between the tab 26 and a' further location of the bolt 2.

As is known, the bolt 2 is a mechanical part of the firearm which blocks a rear of the associated chamber during burning of the propellant. In semi-automatic firearms, such as is the case AR-15 type firearms, the bolt is caused to cycle back and forth during each cartridge discharge cycle, propelled by recoil/expanding gas (backwards) or spring recoil (forwards). Upon moving back, an elongated lug disposed upon a bottom of the reciprocating bolt strips the cartridge casing (also not shown) from the magazine 18 and pushes it into the firearm chamber (see FIG. 1). Upon discharge, and once the spent shell casing case is clear of the chamber, an ejector component (also not shown but understood to also include an integral component of the bolt along with the firing pin), ejects the casing from the receiver and out of the firearm. As finally shown in FIG. 6C, the bolt catch actuator 12 is depressed by the bolt catch 21, such as to release the bolt 2.

In this fashion, the bolt catch kit functions to retain the bolt 2 in a hold open position (again FIG. 6B) following discharge of a last cartridge and upward displacement of the follower 24 into contact with the catch actuator 12 and slaved catch 21, again via window 22 defined in the actuator 12 within which the catch 21 is seated. In this fashion, the bolt 2 is caused to remain open upon removal of the magazine 18 with selective release capability.

Referring finally to each of FIGS. 7 and 7A-7E, a series of perspective, plan and exploded views are successively depicted of a modification of bolt catch actuator housing 34 and which is largely similar to that previously depicted at 10. The housing 34 likewise exhibits a generally elongated configuration and with a rectangular inwardly facing closed perimeter 36 defining an internal opening which communicates with the receiver chamber 16. An adjustable screw 38 (illustrated in each of FIGS. 7C, 7D and 7E) is incorporated into a bottom end location of the housing 34, see also internally threaded aperture 40 in FIG. 7E, such that rotative displacement of the screw 38 results in contact with and vertical displacement of an underside abutting location associated with a support structure 42 of a catch actuator 44 and for vertically raising and lowering the catch actuator 44 to an optimal height location, such as to remove and residual slack or play in the actuator, and in order to ensure that the bolt catch 21 does not interfere with reciprocating bolt operation until a last round within the magazine is discharged.

Figure 7:
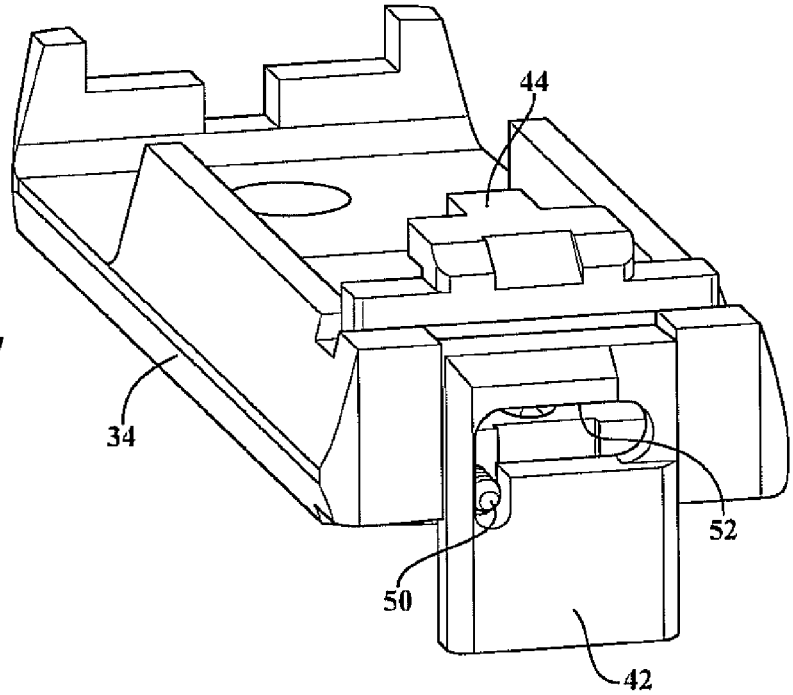
FIGS. 7 and 7A-7E present a variety of perspective, plan and exploded view of the modified actuator housing depicted in FIG. 5 and further illustrating the feature of the bottom adjustable screw for vertically raising and lowering the catch actuator to an optimal height location, such as to remove and residual slack or play in the actuator, and in order to ensure that the bolt catch does not interfere with reciprocating bolt operation until a last round within the magazine is discharged.
Figure 7A:
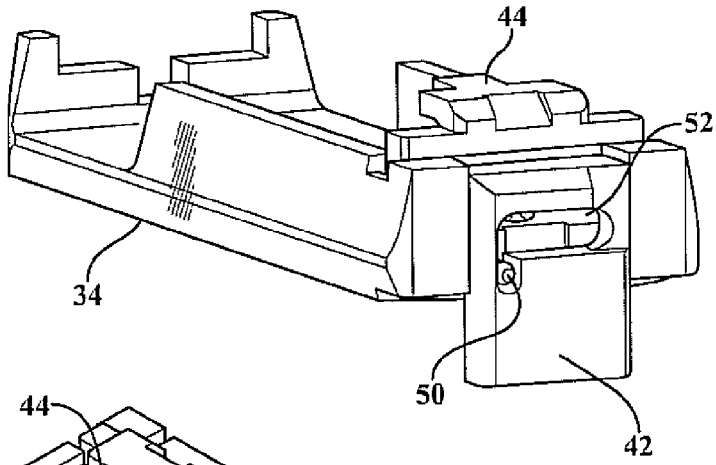
Figure 7B:
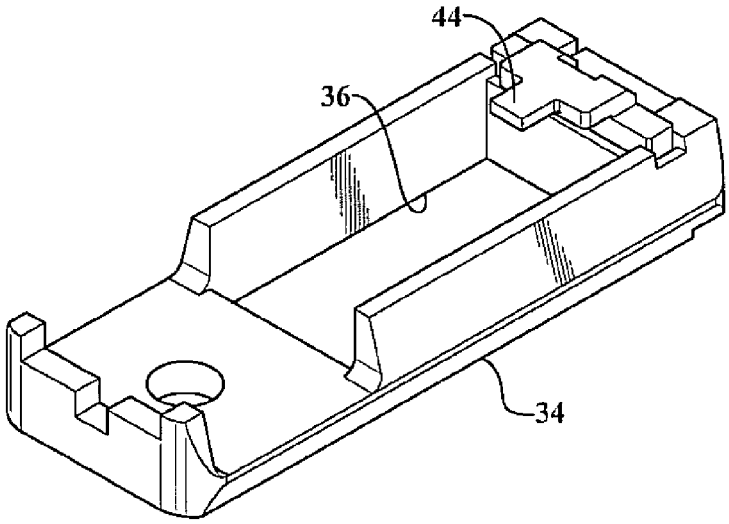
Figure 7C:
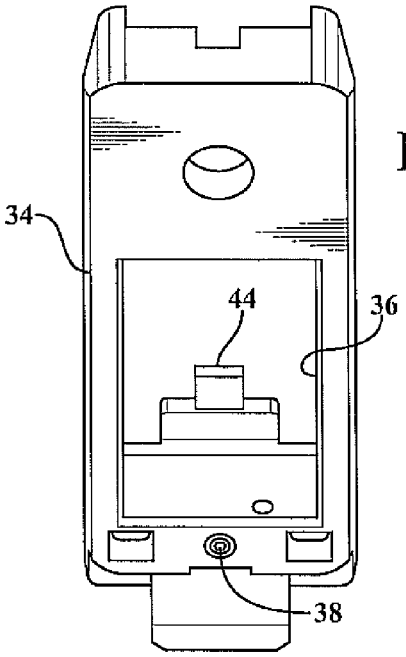
Figure 7D:
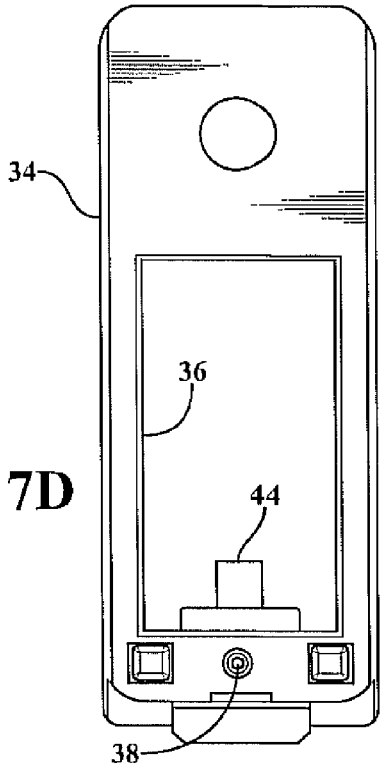
Figure 7E:
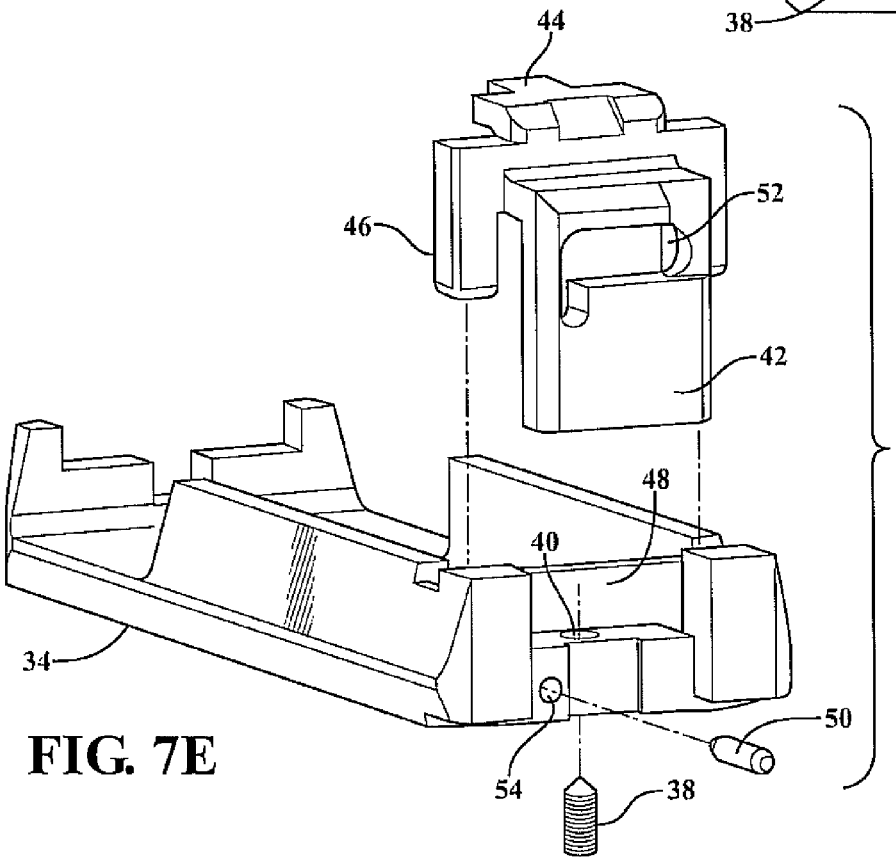

Additional features also depicted in the earlier variant 12 of the catch actuator again include a further pair of inwardly spaced legs or tabs 46 (FIG. 7E) relative to the outer support structure 42 in order to support the catch actuator 44 upon an edge defined surface 48 (again FIG. 7E) of the housing 34. A secondary locating pin 50 is installed horizontally through a slot 52 (as best shown in FIG. 7) and engaged through a further aperture 54 (FIG. 7E) in order to define a range of vertical motion of the catch actuator as defined by the vertical component of the slot 52 in the support structure 42.

In operation, the interface between the follower assembly 24 and the bolt catch actuator 12 and housing 10 operate to provide a last shot bolt open condition, such as in conjunction with a rimfire style ammunition which varies the engagement structure established between the firearm configured bolt catch 18/20 and shell base.

Having described my invention, other and additional preferred embodiments will become apparent to those skilled in the art to which it pertains, and without deviating from the scope of the appended claims.

We claim:

1. A bolt catch assembly configured for operating with rimfire ammunition and incorporated into a firearm exhibiting a reciprocating bolt assembly within a receiver exhibiting an exposed chamber, an ammunition containing magazine engaging within the receiver at a communicating underside of the chamber, the receiver further including an internally supported and upwardly biased follower, a user engageable portion mounted to the receiver and vertically displacing an integrally formed catch, said assembly further comprising:

an actuator housing exhibiting a perimeter and within which is defined an open interior, said actuator housing being configured to be seated upon an upper surface of the receiver such that said open interior communicates with the exposed chamber;

a catch actuator supported in elevatable fashion upon an end of said actuator housing in engagement with the integrally formed catch, a tab portion of said catch actuator extending over the open interior established between said actuator housing and the exposed chamber; and upon discharging a remaining cartridge from within the magazine, the upwardly biased follower contacting and elevating said catch actuator and catch to an upper position for abutting and restraining forward travel of the reciprocating bolt assembly in order to establish a last shot bolt hold open condition, subsequent downward actuation of the user engageable portion releasing the bolt assembly.

2. The assembly as described in claim 1, said actuator housing further comprising a generally rectangular shape, said catch actuator including a spaced apart and downwardly extending legs which contact opposite sides of an end location of said actuator housing and in order to support said catch actuator in each of a seated rest position and a follower induced and upwardly displaced position.

3. The assembly as described in claim 2, further comprising a window defined within a selected and spaced apart leg through which is adapted to seat the catch.

4. The assembly as described in claim 3, further comprising an adjustment screw incorporated into a bottom end location of said actuator housing and, upon rotating, vertically displacing said catch actuator in either of opposite linear directions to modify a contact location established with a forward edge location of the follower, as well as varying a seating location of the catch within the window.

5. The assembly as described in claim 4, further comprising a locating pin installed horizontally into an end surface of said actuator housing, said pin extending through a vertical slot forming a portion of said window in said selected leg of said catch actuator in order to define a range of vertical motion of said catch actuator.

6. A bolt catch assembly incorporated into a firearm exhibiting a reciprocating bolt assembly within a receiver having an exposed chamber, a user engageable portion integrated into the firearm including an integrally formed and elevatable catch; said assembly comprising:

an actuator housing having a generally rectangular shape with an inner perimeter extending wall defining an open interior, said housing seating upon an upper surface of the receiver such that the open interior is adapted to overlay the exposed chamber; and a catch actuator supported in elevatable fashion upon an end of said actuator housing, said catch actuator having a tab portion extending over the open interior which is adapted to engage the elevatable catch to an upper position for abutting and restraining forward travel of the reciprocating bolt assembly, such as in order to establish a last shot bolt hold open condition, subsequent downward actuation of the user engageable portion depressing said catch actuator and releasing the bolt assembly.

7. The assembly as described in claim 6, said catch actuator further comprising spaced apart and downwardly extending legs which contact opposite sides of an end location of said actuator housing in order to support said catch actuator in each of a seated rest position and a follower induced and upwardly displaced position.

8. The assembly as described in claim 7, further comprising a window defined within a selected and spaced apart leg through which is adapted to seat the catch.

9. The assembly as described in claim 8, further comprising an adjustment screw incorporated into a bottom end location of said actuator housing and, upon rotating, vertically displacing said catch actuator in either of opposite linear directions to modify a contact location established with a forward edge location of the follower, as well as varying a seating location of the catch within the window.

10. The assembly as described in claim 9, further comprising a locating pin installed horizontally into an end surface of said actuator housing, said pin extending through a vertical slot forming a portion of said window in said selected leg of said catch actuator in order to define a range of vertical motion of said catch actuator.

* * * * *